US011363858B2

(12) United States Patent
Turner et al.

(10) Patent No.: US 11,363,858 B2
(45) Date of Patent: Jun. 21, 2022

(54) WATERPROOF ZIPPER PULL SYSTEM

(71) Applicant: Airo Importation, Inc., Escondido, CA (US)

(72) Inventors: Craig V Turner, Escondido, CA (US); James Mihal, Vista, CA (US)

(73) Assignee: Airo Importation, Inc., Escondido, CA (US)

( * ) Notice: Subject to any disclaimer, the term of this patent is extended or adjusted under 35 U.S.C. 154(b) by 0 days.

(21) Appl. No.: 16/841,373

(22) Filed: Apr. 6, 2020

(65) Prior Publication Data

US 2021/0307459 A1 Oct. 7, 2021

(51) Int. Cl.
*A44B 19/26* (2006.01)

(52) U.S. Cl.
CPC ..... *A44B 19/262* (2013.01)

(58) Field of Classification Search
CPC ..... A44B 19/262
See application file for complete search history.

(56) References Cited

U.S. PATENT DOCUMENTS 4,193,172 A * 3/1980 Kanzaka ..... A44B 19/262 24/704.1
4,873,750 A * 10/1989 Tracy ..... A44B 19/262 24/429
7,293,335 B2 * 11/2007 Tseng ..... A44B 19/301 24/415
7,516,523 B2 * 4/2009 Okot ..... A44B 19/262 24/382
9,545,158 B2 * 1/2017 Goldberg ..... A47C 31/007
9,877,550 B1 * 1/2018 Chen ..... A44B 19/262
2002/0070566 A1 * 6/2002 Hudson ..... A44B 19/301 292/315
2004/0020017 A1 * 2/2004 Nedbal ..... A44B 19/262 24/429
2005/0050698 A1 * 3/2005 Muratsubaki ..... A44B 19/262 24/429
2005/0198789 A1 * 9/2005 Wang ..... A44B 19/262 24/429
2007/0124901 A1 * 6/2007 Cyr ..... A44B 19/262 24/429
2011/0126383 A1 * 6/2011 Takazawa ..... A44B 19/26 24/389
2012/0102646 A1 * 5/2012 Chen ..... A47C 31/105 5/499
2015/0321399 A1 * 11/2015 Hong ..... C08L 75/04 524/539
2016/0007692 A1 * 1/2016 Chen ..... A44B 19/42 24/429
2017/0164697 A1 * 6/2017 Chen ..... A44B 19/262
2019/0021452 A1 * 1/2019 Huang ..... E05B 37/02

* cited by examiner

*Primary Examiner* — David M Upchurch
(74) *Attorney, Agent, or Firm* — Insigne PC

(57) ABSTRACT

A zipper pull, a head portion of which is structurally configured to fit snugly into a housing structure (referred to as a "garage") is located at the top stops of an otherwise conventional waterproof or water resistant zipper. The garage and zipper pull thereby forming form a water resistant seal to eliminate any chance of water penetration in water resistant and waterproof zippers.

13 Claims, 5 Drawing Sheets

WATERPROOF ZIPPER PULL SYSTEM

BACKGROUND OF THE INVENTION

1. Field of Invention

The present invention relates to zipper pulls for zippers.

2. Description of Related Art

A zipper, zip, fly, dingy, or zip fastener, formerly known as a clasp locker, is a commonly used device for binding edges of an opening of fabric or other flexible material, such as on a garment or a bag. Zippers are used in clothing (e.g., jackets and jeans), luggage and other bags, sporting goods, camping gear (e.g., tents and sleeping bags), and other items. Zippers come in all different sizes, shapes, and colors.

Referring to FIG. 1, components of a typical standard zipper are: a top tape extension 1 (the fabric part of the zipper, that extends beyond the teeth, at the top of the chain); a top stop 2 (two devices affixed to the top end of a zipper, to prevent the slider from coming off the chain); slider 3 (the device that moves up and down the chain to open or close the zipper); a pull tab or puller 4 (the part of the slider that is held to move the slider up or down); a tape width 5 (refers to the width of the fabric on both sides of the zipper chain); a chain or zipper teeth 6 (the continuous piece that is formed when both halves of a zipper are meshed together) and chain width (refers to the specific gauge of the chain—common gauge sizes are #3, #5, #7, #8 and #10, the bigger the number, the wider the teeth/chain width is; a bottom stop 7 (a device affixed to the bottom end of a zipper, to prevent further movement of the half of the zipper from separating); a bottom tape extension 8 (the fabric part of the zipper, that extends beyond the teeth, at the bottom of the chain); a single tape width 9 (refers to the width of the fabric on one side of the zipper chain); an insertion pin 10 (a device used on a separating zipper whose function is to allow the joining of the two zipper halves); a retainer box or pin box 11 (a device used on a separating zipper whose function is to correctly align the pin, to begin the joining of the zipper halves); and a reinforcement film 12 (a strip of plastic fused to each half of the zipper tape to allow a manufacturer to electronically "weld" the zipper onto the garment or item that is being manufactured, without the need of sewing or stitching).

Airtight zippers were first developed by NASA for making high-altitude pressure suits and later space suits, capable of retaining air pressure inside the suit in the vacuum of space. The airtight zipper is built like a standard toothed zipper, but with a waterproof sheeting (which is made of fabric-reinforced polyethylene and is bonded to the rest of the suit) wrapped around the outside of each row of zipper teeth. When the zipper is closed, the two facing sides of the plastic sheeting are squeezed tightly against one another (between the C-shaped clips) both above and below the zipper teeth, forming a double seal. This double-mated surface is good at retaining both vacuum and pressure, but the fit must be very tight, to press the surfaces together firmly. Consequently, these zippers are typically very stiff when zipped shut and have minimal flex or stretch. They are hard to open and close because the zipper anvil must bend apart teeth that are being held under tension. They can also be derailed (and damage the sealing surfaces) if the teeth are misaligned while straining to pull the zipper shut. These zippers are very common where airtight or watertight seals are needed, such as on scuba diving dry suits, ocean survival suits, and hazmat suits. In addition, they are relatively expensive and not practical for everyday use.

Another water-resistant zipper is similar in construction to a standard toothed zipper, but includes a molded plastic ridge seal similar to the mating surfaces on a ziploc bag. Such a zipper is easier to open and close than a clipped version, and the slider has a gap above the zipper teeth for separating the ridge seal. This seal is structurally weak against internal pressure, and can be separated by pressure within the sealed container pushing outward on the ridges, which simply flex and spread apart, potentially allowing air or liquid entry through the spread-open ridges. Ridge-sealed zippers are sometimes used on lower-cost surface dry suits.

No matter how water-resistant or water-proof the zipper teeth are when closed, a zipper pull and its respective slider often allow water penetration at the top stop.

In light of these challenges in the field, there is a need for an improved zipper pull system, which functions similar to a standard zipper while remaining inexpensive and practical for everyday use.

SUMMARY OF THE INVENTION

The present invention overcomes these and other deficiencies of the prior art by providing an improved zipper pull structurally configured to fit snugly into a housing structure (referred to herein as a "garage") located at the top stops of an otherwise conventional waterproof or water resistant zipper. The garage and zipper pull thereby forming a water resistant seal to eliminate any chance of water penetration in water resistant and waterproof zippers.

In an embodiment of the invention, a zipper pull system comprises: a zipper pull; and a garage comprising an opening, wherein a portion of the zipper pull is shaped to form a seal within the opening of the garage. The zipper pull can further comprise a clasp. The garage does not enclose the clasp. The zipper pull system can further comprise a slider coupled to the zipper pull, wherein the garage is shaped to enclose the slider. The portion of the zipper pull can comprise a gasket. The zipper pull system can be used in an article of clothing, an article of luggage, a storage bag, a sporting good, or a camping good.

In another embodiment of the invention, a zipper comprises: zipper teeth; a slider coupled to the zipper teeth; a zipper pull coupled to the slider, wherein the zipper pull comprises a head; and a garage disposed at one end of the zipper teeth, wherein the garage includes an opening shaped to form a seal with the head. The garage is also shaped to enclose the slider. The seal is a waterproof seal. The zipper pull can comprise a clasp, wherein the garage does not enclose the clasp. The zipper can be used in an article of clothing, an article of luggage, a storage bag, a sporting good, or a camping good.

In yet another embodiment of the invention, a zipper pull comprises: a clasp region; and a head region, wherein the head region is shaped to form a seal with an opening of a garage.

The foregoing, and other features and advantages of the present invention, will be apparent from the following, more particular description of the preferred embodiments of the present invention and the accompanying drawings.

BRIEF DESCRIPTION OF THE DRAWINGS

For a more complete understanding of the present invention, the objects and advantages thereof, reference is now made to the ensuing descriptions taken in connection with the accompanying drawings briefly described as follows.

DETAILED DESCRIPTION OF PREFERRED EMBODIMENTS

Figure 1:
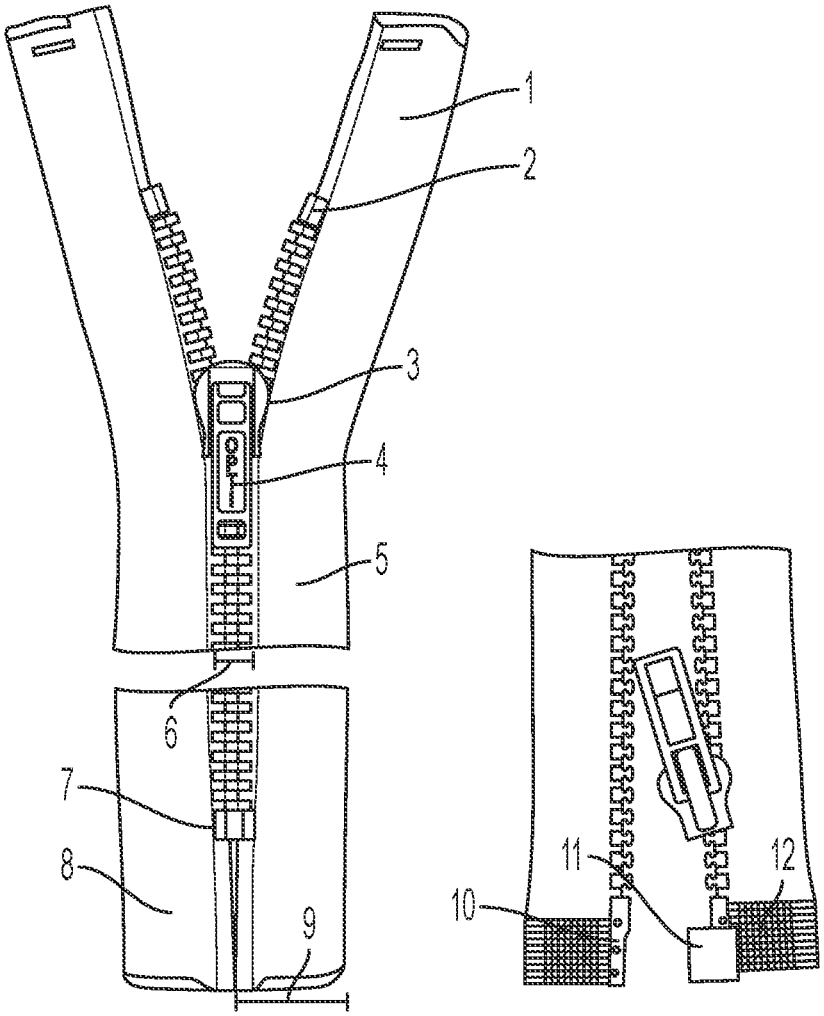
FIG. 1 PRIOR ART
FIG. 1 illustrates typical components of a standard zipper.
Figure 2:
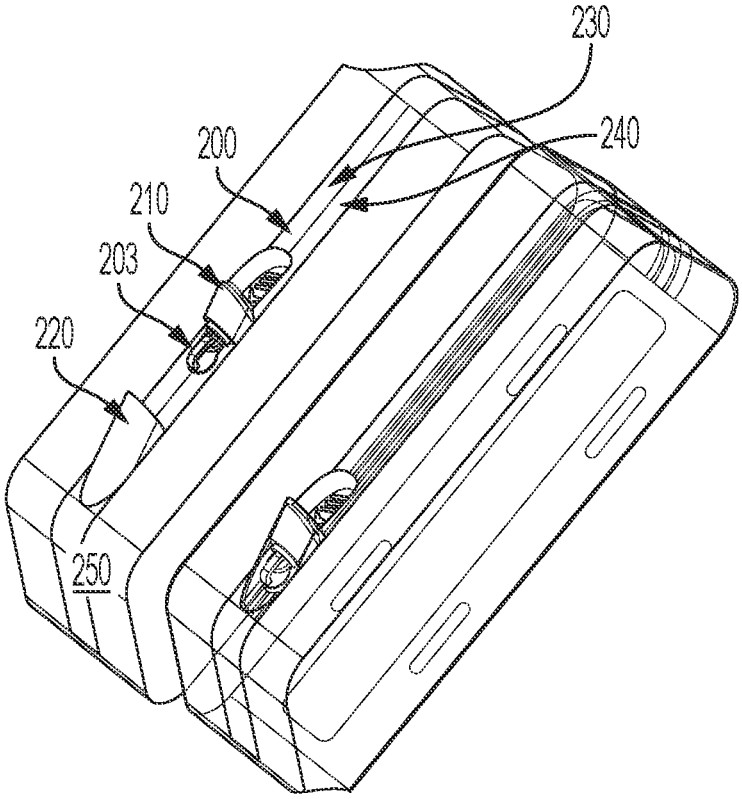
FIG. 2 illustrates a waterproof zipper pull system according to an embodiment of the present invention.
Figure 3:
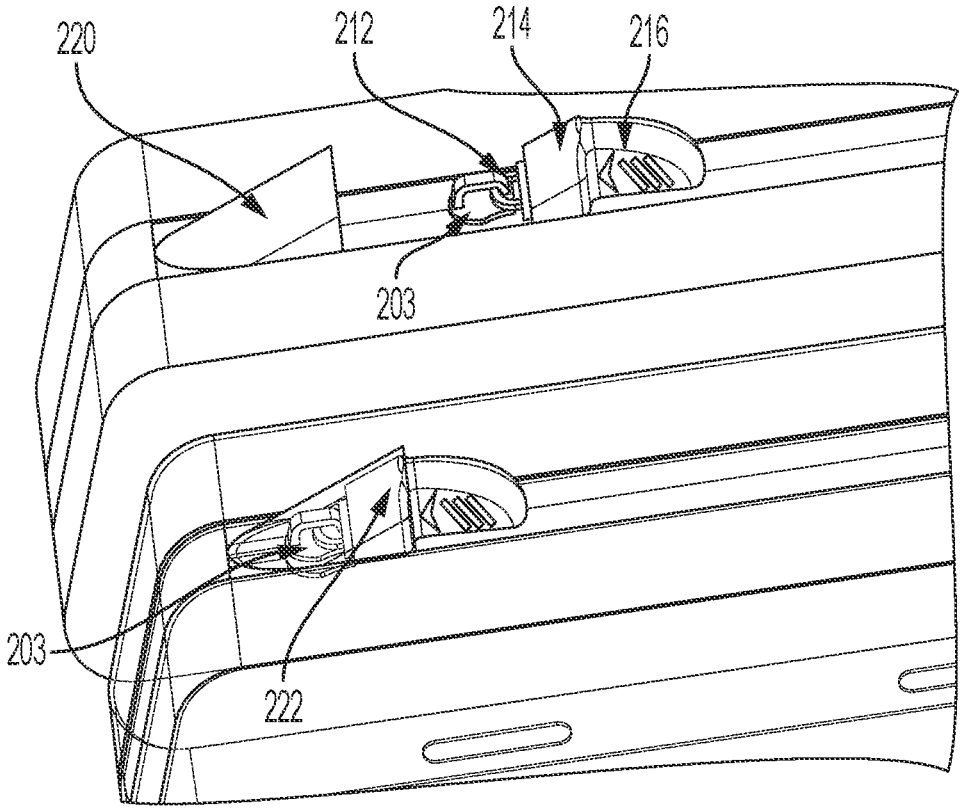
FIG. 3 illustrates a zipper pull and a corresponding garage of the waterproof zipper of FIG. 2.
Figure 4:
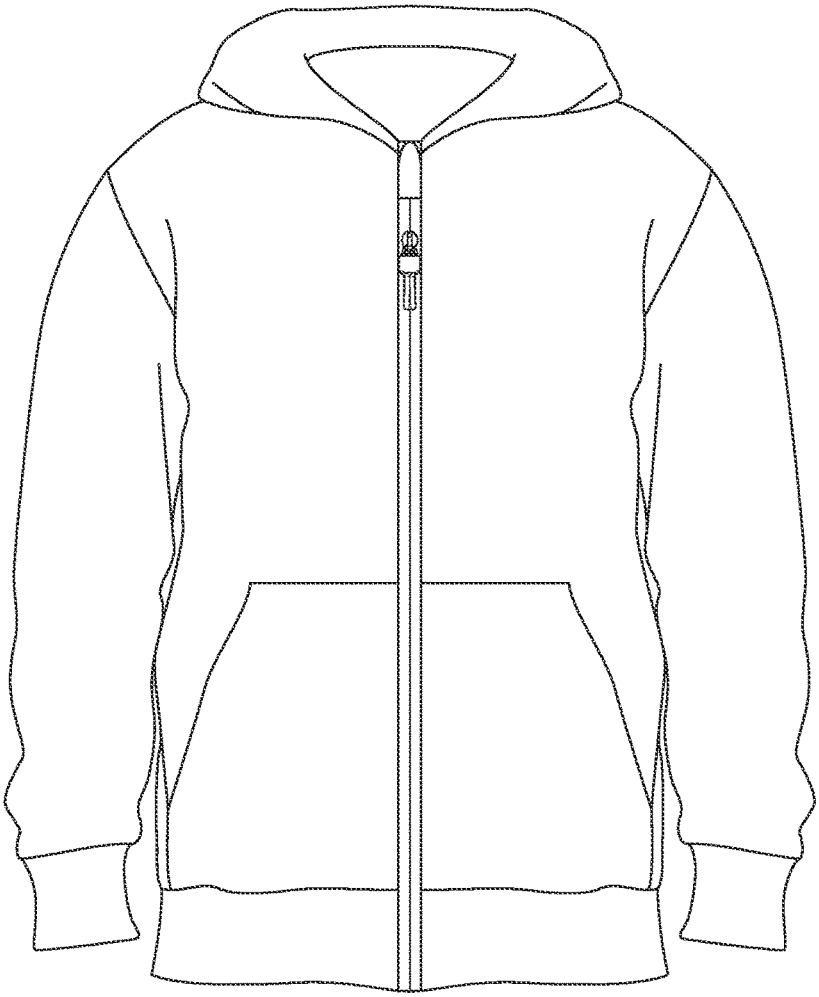
FIG. 4 illustrates a zipper pull and corresponding garage of the waterproof zipper of FIG. 2 on an article of clothing.
Figure 5:
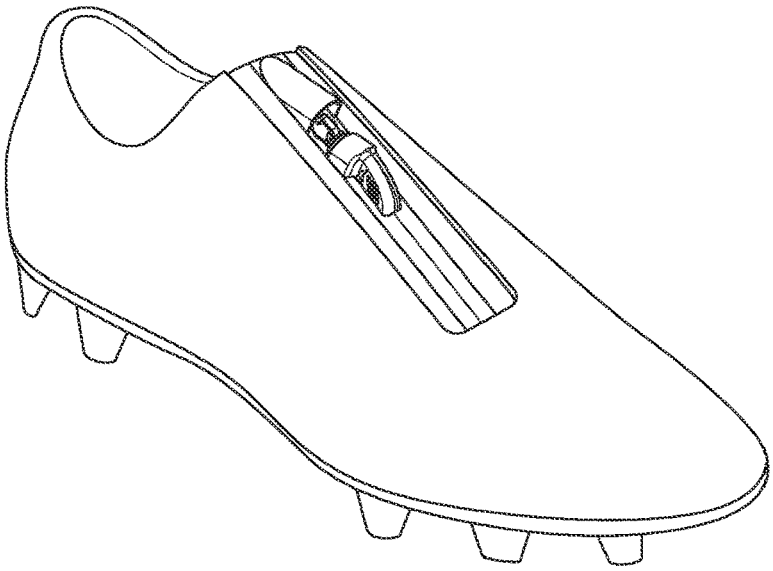
FIG. 5 illustrates a zipper pull and corresponding garage of the waterproof zipper of FIG. 2 comprising a sporting good.
Figure 6:
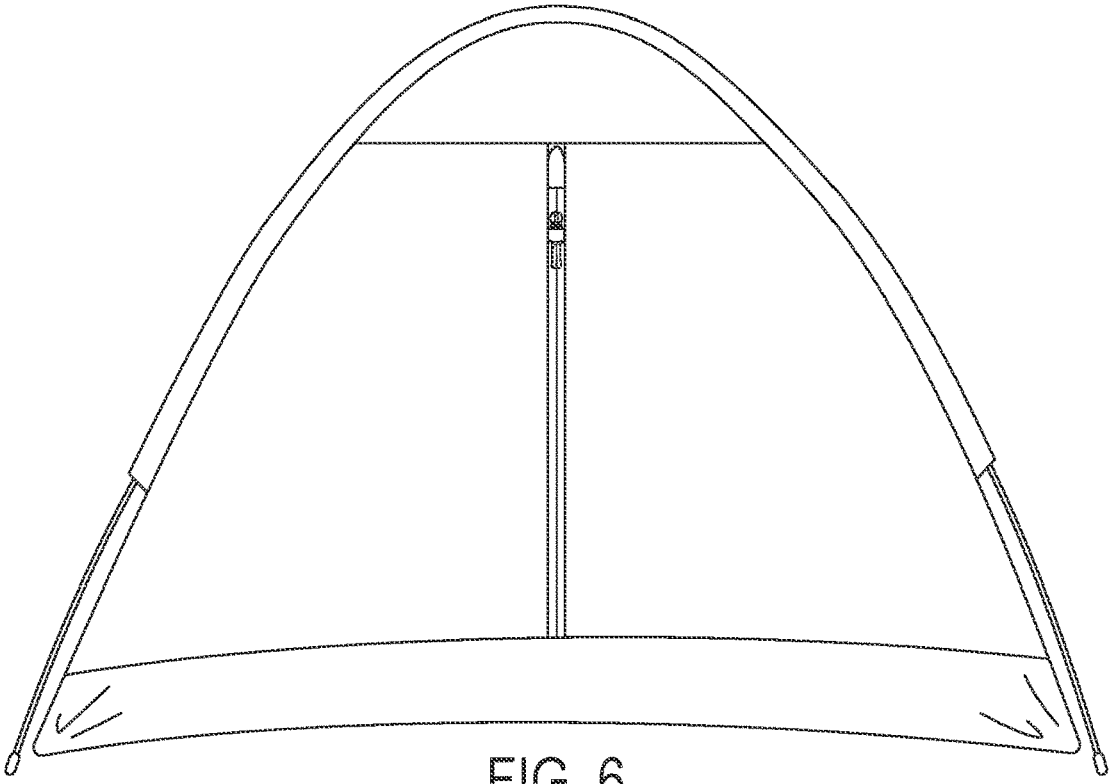
FIG. 6 illustrates zipper pull and corresponding garage of the waterproof zipper of FIG. 2 comprising a camping good.
Figure 7:
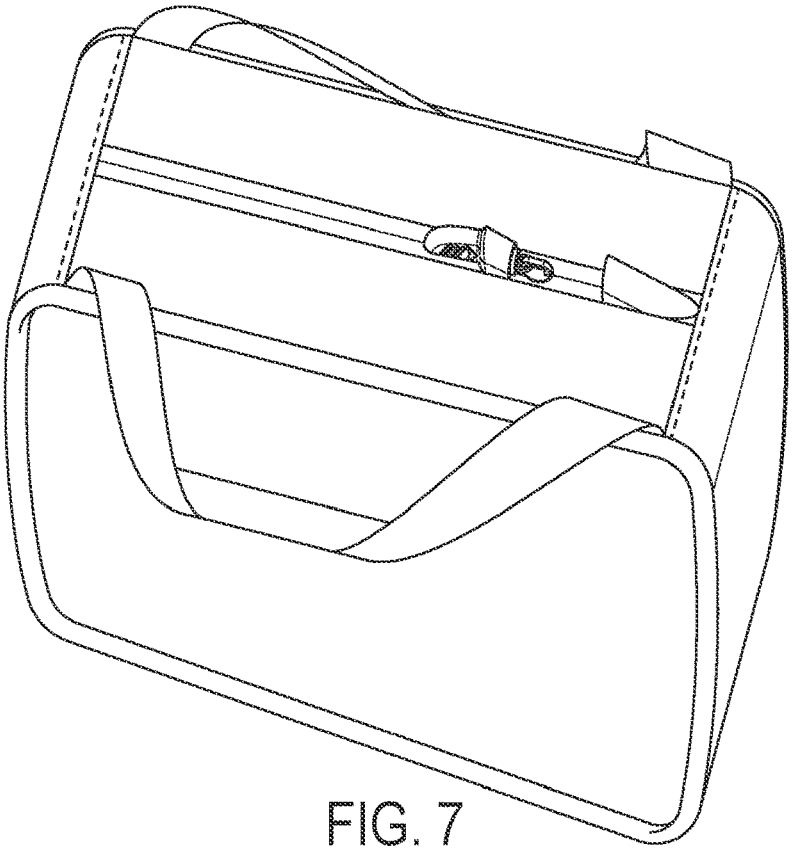
FIG. 7 illustrates zipper pull and corresponding garage of the waterproof zipper of FIG. 2 comprising a storage bag.

Preferred embodiments of the present invention and their advantages may be understood by referring to FIGS. 1-3, wherein like reference numerals refer to like elements. Although the invention is described in the context of a storage bag, the present invention is applicable to any type of item where a zipper is useful for opening and closing of an inner compartment thereon, such as, but not limited to clothing, luggage and other bags, sporting goods, and camping gear.

FIG. 2 illustrates a zipper 200 according to an embodiment of the invention. The zipper 200 is affixed to a surface of a storage bag 250 and is shown in both an open position (top left) and a closed position (bottom right). The zipper 200 comprises a zipper pull 210 and a garage 220. The zipper pull 210 is attached to a slider 203. Water resistant flaps 230 and 240 comprise a pliable rubber or plastic compound, which meet together on the centerline of zipper teeth (hidden from view, but located on the inside surface of), the implementation of which is apparent to one of ordinary skill in the art. In an embodiment of the invention, the flaps are coated with a water repellant such as, but not limited to polyeurathane.

Referring to FIG. 3, which illustrates a close up of the zipper pull 210 and the garage 220 in both an open position (top) and a closed position (bottom see through illustration of garage 220), the zipper pull 210 comprises a loop 212, a head 214, and a clasp 216. The loop 212 secures the zipper pull 210 to the slider 203. In an embodiment of the invention, the head 214 has a radius to allow a concentric fit against the inside of the garage 220. In alternative embodiments of the invention, The male zipper pull 210 could be almost any shape as long as it sealed against the female inside of the garage 220. The bottom of the pull 210 is flat to seal against the outer surface of the flaps 230 and 240. A rubber seal or gasket (not shown) could also be disposed on the periphery of the pull head 214 to form a waterproof seal when inside the garage 220.

The garage 220 includes an opening 222 shaped to snugly cover the head 214 when inserted therein (as shown in closed position—see bottom). The garage 220 is sized to also receive the slider 203 in the closed position. The clasp 216 is held by a user's hand, e.g., between a thumb and index finger, and moved between the open position and closed position, and vice versa. By having the head 214 fit snugly within the garage 220, a waterproof seal is formed. Friction within the zipper teeth (not shown) keep the garage 220 in the closed position. In the closed position, the clasp 216 remains available for a user to open the zipper 200.

The garage 220 can be made of any material that can be formed, cast, 3D printed, computer numerical control (CNC) machined, manually machined, injection molded, or vacuum formed, as long as the inner surface of the garage 220 and the head 210 fit snugly so that when they are used in conjunction with each other they allow for a complete seal.

In an embodiment of the invention, the zipper pull 210 is made from plastic via polymer casting, 3D printing, CNC machining, vacuum forming, injection moulding, or any suitable process, the identification and implementation of which is apparent to one of ordinary skill in the art. In an alternative embodiment of the invention, the zipper pull 210 is made from a rigid material such as wood, metal, rubber, or any suitable material, the identification and implementation of which is apparent to one of ordinary skill in the art.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Moreover, the described features, structures, or characteristics of the invention may be combined in any suitable manner in one or more embodiments. It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents. Reference will now be made in detail to the preferred embodiments of the invention.

The invention has been described herein using specific embodiments for the purposes of illustration only. It will be readily apparent to one of ordinary skill in the art, however, that the principles of the invention can be embodied in other ways. Therefore, the invention should not be regarded as being limited in scope to the specific embodiments and claims.

We claim:

1. A zipper pull system comprising:

a zipper pull, wherein the zipper pull further comprises a loop, a head, a clasp, and a slider coupled to the zipper pull; and a garage comprising an opening, wherein a portion of the head is shaped to form a seal within the opening of the garage and wherein the garage is shaped to enclose the slider to form a waterproof seal.

2. An article of clothing comprising the zipper pull system of claim 1.

3. An article of luggage comprising the zipper pull system of claim 1.

4. A storage bag comprising the zipper pull system of claim 1.

5. A sporting good comprising the zipper pull system of claim 1.

6. A camping good comprising the zipper pull system of claim 1.

7. A zipper comprising:

zipper teeth;

a slider coupled to the zipper teeth;

a zipper pull coupled to the slider, wherein the zipper pull comprises a head, wherein a portion of the head is shaped to form a waterproof seal within an opening of a garage, wherein the zipper pull further comprises a clasp; and a garage disposed at one end of the zipper teeth, wherein the garage includes an opening shaped to form a waterproof seal with the head.

8. The zipper of claim 7, the zipper pull further comprising a clasp, wherein the garage does not enclose the clasp.

9. An article of clothing comprising the zipper of claim 7.

10. An article of luggage comprising the zipper of claim 7.

11. A storage bag comprising the zipper of claim 7.

12. A sporting good comprising the zipper of claim 7.

13. A camping good comprising the zipper of claim 7.

* * * * *